US005469125A

United States Patent [19]

Shigemoto et al.

[11] Patent Number: 5,469,125

[45] Date of Patent: Nov. 21, 1995

[54] ROTARY ELECTRONIC DEVICE

[75] Inventors: Hideki Shigemoto, Moriguchi; Hiroshi Matsui, Hirakata; Jun Sugahara, Kume, all of Japan

[73] Assignee: Matsushita Electric Industrial Co., Ltd., Kadaoma, Japan

[21] Appl. No.: 227,646

[22] Filed: Apr. 14, 1994

[30] Foreign Application Priority Data

| | | | |
|---|---|---|---|
| Apr. 15, 1993 | [JP] | Japan | 5-088403 |
| May 27, 1993 | [JP] | Japan | 5-125737 |
| Oct. 8, 1993 | [JP] | Japan | 5-252847 |

[51] Int. Cl.[6] ..... H01C 10/32

[52] U.S. Cl. ..... 338/162; 338/166; 338/175

[58] Field of Search ..... 338/160, 162, 338/118, 164, 166, 167, 169, 170, 173, 175, 176, 168

[56] References Cited

U.S. PATENT DOCUMENTS

| | | | |
|---|---|---|---|
| 2,143,401 | 1/1939 | Arvin | 338/162 |
| 2,346,598 | 4/1944 | Mucher | 338/162 |
| 2,781,436 | 2/1957 | Barden | 338/162 |
| 3,427,680 | 2/1969 | Gilbert | 338/162 |
| 3,654,581 | 4/1972 | Franz, Jr. | 338/162 |
| 3,902,152 | 8/1975 | Van Benthuysen | 338/162 |
| 5,349,323 | 9/1994 | Shigemoto et al. | 338/176 |

FOREIGN PATENT DOCUMENTS

| | | |
|---|---|---|
| 339968 | 11/1989 | European Pat. Off. . |
| 3524308 | 1/1987 | Germany . |
| 57-173229 | 11/1982 | Japan . |
| 2174250 | 10/1986 | United Kingdom . |

OTHER PUBLICATIONS

Patent Abstracts of Japan, vol. 13, No. 450, (E-830), Oct. 11, 1989, & JP-A-01 175 201.

*Primary Examiner*—Tu Hoang
*Attorney, Agent, or Firm*—Cushman, Darby & Cushman

[57] ABSTRACT

A rotary electronic device of a neutral position return type having an output that is controlled in a stepless mode. A rotary variable resistor of the rotary electronic device is installed on a tubular holder, and a torsion coil spring is disposed between a manipulation knob and the tubular holder. The neutral position return is very simply configured by using a small sized rotary variable resistor.

8 Claims, 14 Drawing Sheets

ROTARY ELECTRONIC DEVICE

FIELD OF THE INVENTION AND RELATED ART STATEMENT

1. Field of the Invention

The present invention relates to a rotary electronic device which is suitable, for instance for use in a zooming speed controlling unit of a video camera.

2. Description of the Related Art

Because a zooming speed controlling unit of a video camera is required for zooming out on the "TELE (telescopic)" side and zooming in on "WIDE (wide range)" side, and to instantaneously stop the movement of a lens unit of the video camera at a predetermined position, a seesaw manipulation-type switch having a neutral position return-motion is widely used in an operation unit for the zooming speed controlling unit.

A conventional seesaw manipulation-type switch disclosed in the Japanese unexamined Utility Model Publication No. (Jikkai Sho) 57-173229 will be explained with reference to FIGS. 15–18.

FIG. 15 is an exploded perspective view showing a seesaw manipulation-type switch used in a conventional seesaw manipulation-type electronic device. FIG. 16 is a front view showing a base plate of the conventional seesaw manipulation-type electronic device. FIG. 17 is a front view of the base plate of FIG. 16. FIG. 18 is a front view explaining the operation of a return mechanism of the conventional seesaw manipulation-type electronic device.

In these drawings, a manipulation key 3 of the seesaw manipulation-type switch is rotatably attached to a support shaft 2 in an upper portion of a housing 1. As shown in FIG. 15, under the manipulation key 3, a brush receiving plate 3*a* is extendedly provided to be arranged perpendicularly to the support shaft 2, and an electrically-conductive brush 4 is fixed to the brush-receiving plate 3*a* in a cantilever-fashion. As shown in FIG. 16, the base plate 6 has a plurality of sector-shaped fixed contacts 5*a*, 5*b*, 5*c*, 5*d*, 5*e*, 5*f*, 5*g*, 5*h*, 5*i* and 5*j* formed to have a concentric pattern. The base plate 6 is disposed to face one face of the brush-receiving plate 3*a* in the housing 1, and the brush 4 is arranged to elastically contact a surface of the sector-shaped fixed contacts 5*a*–5*j* on the base plate 6. On the other face of the brush-receiving plate 3*a*, a pair of spring receiving members 7 and 8 are rotatably attached by the support shaft 2. A coil spring 9 is compressively provided between both the spring receiving members 7 and 8. As shown in FIG. 15, a stopping protrusion 1*a* protruding from a side wall of the housing 1 and an engaging pin 3*b* protruding from the brush-receiving plate 3*a* are inserted and interposed between both the spring receiving members 7 and 8 as shown in FIG. 18. In addition, the seesaw manipulation-type switch has a bottom plate 10 and a side plate 11 facing to the base plate 6.

As shown in FIG. 18, when depressing one end of the manipulation key 3, the manipulation key 3 and the brush-receiving plate 3*a* are integrally rotated around the support shaft 2 as a rotation axis. Brush 4 turns and slides on a surface of the base plate 6, thereby a position of contact point in the sector-shaped fixed contacts 5*a*–5*j* (FIG. 16) is changed. In this switching operation, the brush 4 contacts with a particular contact in the plurality of the sector-shaped fixed contacts 5*a*– 5*j* to turn on a circuit connected to the particular contact, or departs from a particular contact in the sector-shaped fixed contacts 5*a*–5*j* to turn off a circuit connected to the particular contact, corresponding to a depressed stroke of the manipulation key 3. On the opposite face of the brush-receiving plate 3*a*, the engaging pin 3*b* turns one of the spring-receiving members 7, 8 against elasticity of the coil spring 9 as shown in FIG. 18.

Thereafter, when releasing the depression operation to on the manipulation key 3, the spring-receiving member 7 or 8 is returned to its initial neutral position by the elasticity of tile coil spring 9, at the same time, the manipulation key 3 and the brush 4 return to the neutral position by contacting between the engaging pin 3*b* and the spring-receiving member 7 or 8.

In recent years, as down-sizing and high accuracy of a video camera have advanced, demand for a neutral position return-type electronic switch is increasing for using in a zooming speed control unit etc., because the neutral position return-type electronic switch having a small size can correspond to many kinds of operation modes and can be disposed on different kinds of mounting positions. Further, the output value of the neutral position return-type electronic switch can be controlled in a stepless mode.

In order to provide the neutral position return-type electronic switch, if a resistor is formed on a base plate by printing or the like instead of the fixed contacts on the base plate 6 of the aforementioned conventional seesaw manipulation-type switch, such switch may be used as a seesaw manipulation-type switch which can be controlled in a stepless mode. However, because the seesaw manipulation-type switch has structure shown in FIG. 15 through FIG. 18, the down-sizing is difficult. Moreover, the structure for returning the manipulation key 3 to the neutral position becomes complex and requires many component parts, leading to high cost.

OBJECT AND SUMMARY OF THE INVENTION

An object of the present invention is to provide a rotary electronic device, which has a neutral-position-returning mechanism, and which uses a torsion coil spring installed on a shaft of the neutral-position-returning mechanism without enlarging a whole of the electronic device.

In order to achieve the above object, the present invention provides a rotary electronic device comprising:

a holder having a circular through-hole;

a rotary variable resistor having connection terminals and a rotary shaft, which is arranged concentrically with the circular through-hole, the rotary variable resistor being disposed at an end portion of the holder, a rotary operation shaft which is rotatably held by the circular through-hole, one end of which is coupled to the rotary shaft of the rotary variable resistor, and the other end of which is provided with stopping step portions for engaging with a protrusion of the holder.

According to the present invention, a rotary electronic device, which has a small size and a low cost, can control an output value thereof in a stepless mode.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DESCRIPTION OF THE PREFERRED EMBODIMENTS

First Embodiment

Hereafter, a knob manipulation-type variable resistor of a first embodiment of a rotary electronic device in accordance with the present Invention will be explained with reference to FIG. 1 to FIG. 5.

Figure 1:
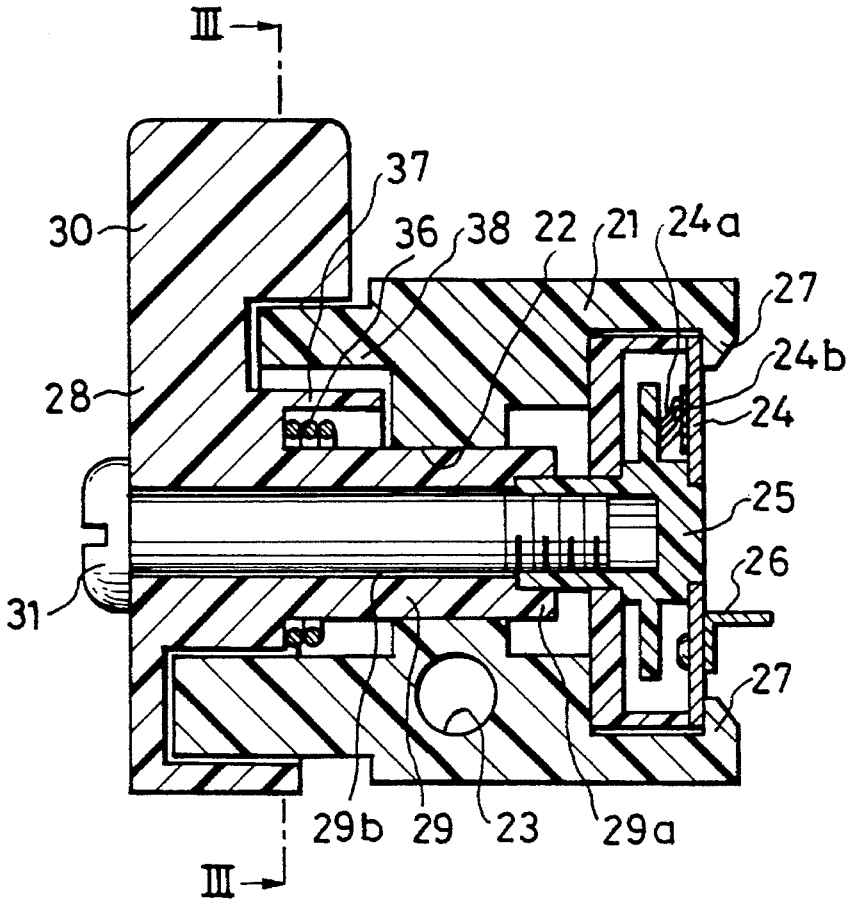
FIG. 1 is a sectional view showing a knob-manipulation-type variable resistor of a first embodiment of a rotary electronic device in accordance with the present invention.
Figure 2:
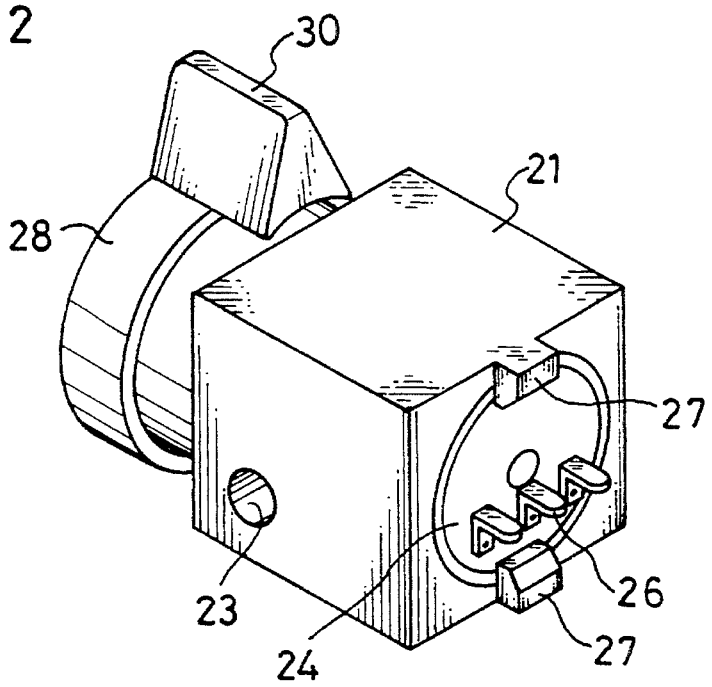
FIG. 2 is a perspective view of the rotary electronic device of FIG. 1.
Figure 3:
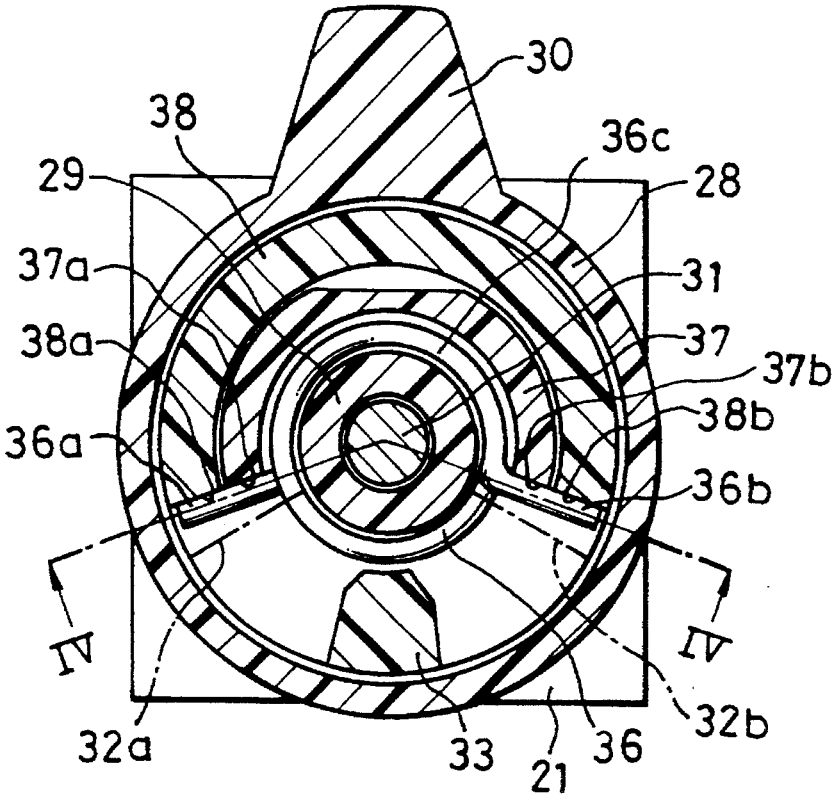
FIG. 3 is a sectional view taken along line III—III of FIG. 1.
Figure 4:
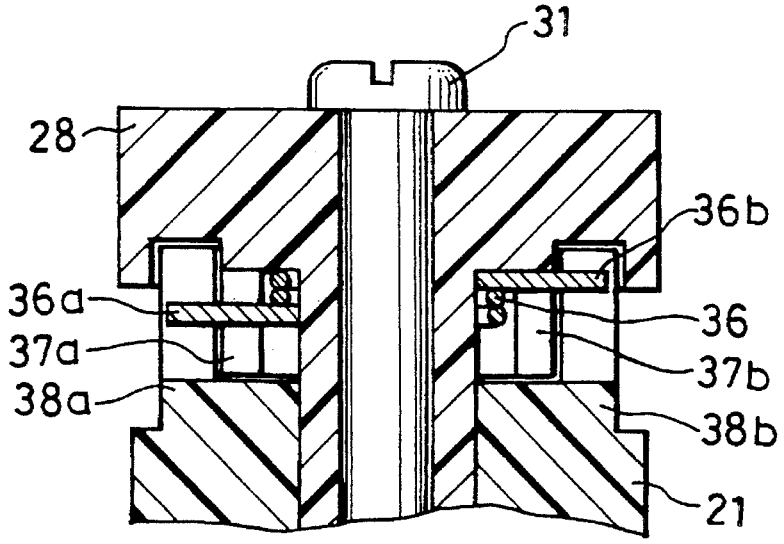
FIG. 4 is a partial sectional view taken along line IV—IV of FIG. 3.
Figure 5:
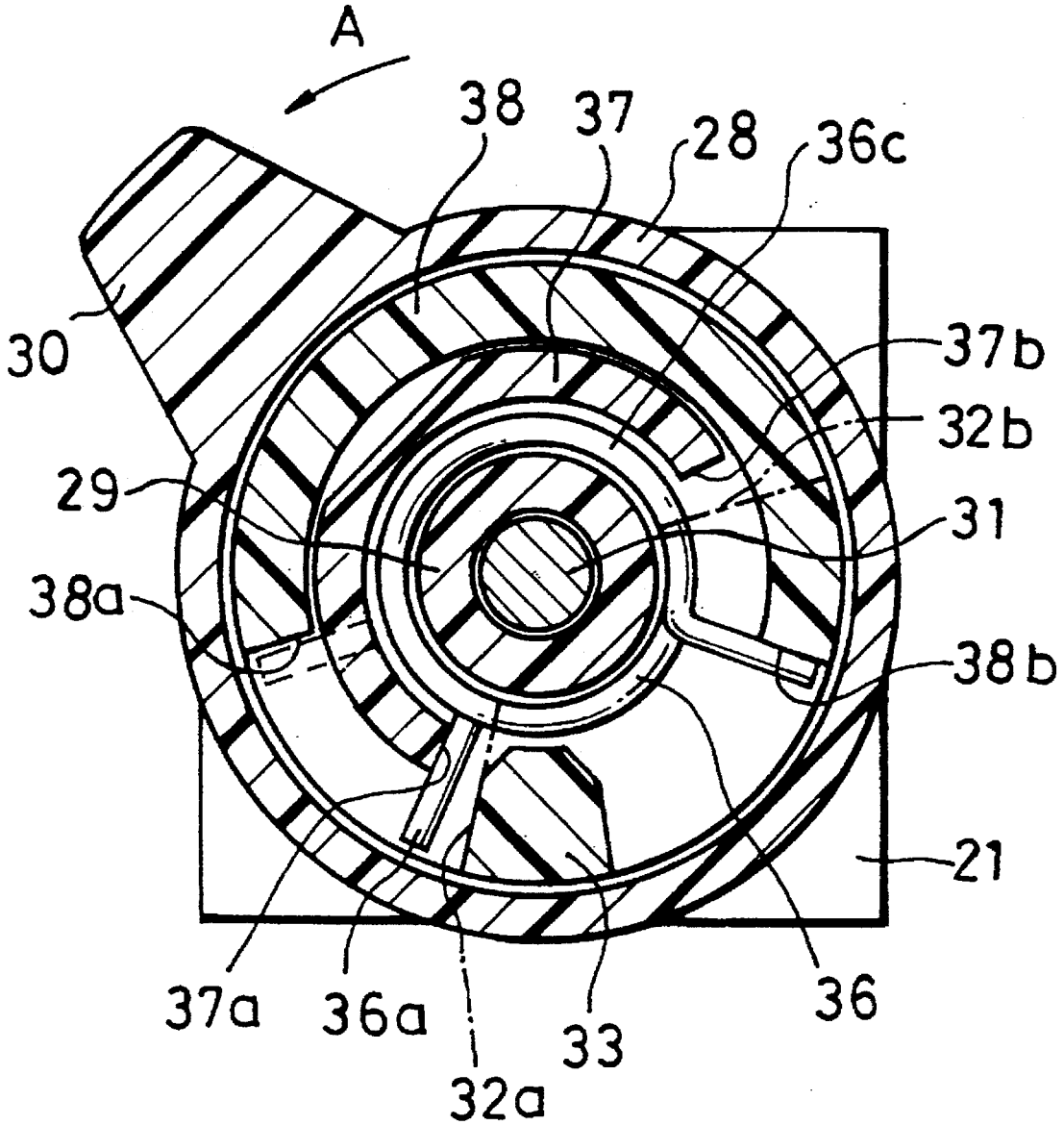
FIG. 5 is a sectional view showing a state wherein the knob manipulation-type variable resistor is operated by pushing a manipulation knob, starting from the state shown in FIG. 3.

FIG. 1 is a sectional view showing the rotary-manipulation-type variable resistor of the first embodiment of the rotary electronic device in accordance with the present invention. FIG. 2 is a perspective view of the rotary electronic device of FIG. 1. FIG. 3 is a sectional view taken along line III—III of FIG. 1. FIG. 4 is a partial sectional view taken along line IV—IV of FIG. 3. FIG. 5 is a sectional view showing a state wherein the knob manipulation-type variable resistor is operated by pushing a manipulation knob, starting from the state shown in FIG. 3.

In FIGS. 1–5, a tubular holder 21 made by resin molding or metal die casting has a circular through-hole 22 in its center portion and a small hole 28 for fixing in its side portion.

A rotary variable resistor 24 has a rotary shaft 25 in the center portion of the tubular holder 21, and connection terminals 26 on the rear face of the tubular holder 21. The rotary shaft 25 is so held by leg portions 27 at a rear end of the tubular holder 21 that it is concentric with the circular through-hole 22 of the tubular holder 21. A plurality of connection terminals 26 protrude from the rear face of the knob manipulation-type variable resistor. A brush **24*a* contacts a resistor 24*b* and slides on it as the rotary shaft 25 turns, thereby varying an output (resistance value) derived from the connection terminals 26**.

A rotary operation shaft 28 is comprised of a circular shaft 29 rotatably held by the circular through-hole 22 of the tubular holder 21 and a manipulation knob 30 radially extending from an end portion of the circular shaft 29. The other end **29*a* of the circular shaft 29 is coupled to the rotary shaft 25 of the rotary variable resistor 24, and a screw 31 inserted into a center hole 29*b* of the circular shaft 29 fixes both of the rotary shaft 25 and the circular shaft 29**.

As shown in FIG. 3, stopping step portions **32*a*, 32*b* are provided at two lower positions of the manipulation knob 30 of the rotary operation shaft 28, and contact a protrusion 33 of the tubular holder 21, so as to regulate a range of turning angles of the rotary operation shaft 28**.

A torsion coil spring 36 is provided for keeping the rotary operation shaft 28 at a predetermined position, namely the manipulation knob 30 at a neutral position. A coil portion **36*c* of the torsion coil spring 36 is disposed on an outer periphery of the circular shaft 29 of the rotary operation shaft 28. Hook portions 36*a*, 36*b* (FIG. 3) formed at both ends of the coil portion 36*c* are in contact with respective end faces 37*a*, 37*b* of step portion 37 provided near the stopping step portions 32*a*, 32*b* of the rotary operation shaft 28. The hook portions 36*a*, 36*b* are in contact with end faces 38*a*, 38*b* of protruding portion 38 arranged outside of the step portion 37 as shown in FIG. 3. The hook portions 36*a*, 36*b* of the torsion coil spring 36 shown in FIG. 3 are in contact with these end faces 37*a*, 37*b*, 38*a* and 38*b* of the step portion 37 and the protruding portion 38 to apply a constant elasticity of the torsion coil spring 36**.

The facing angle between the end faces **38*a*, 38*b* of the protruding portions 38 of the tubular holder 21 are set at an angle that is larger than the facing angle between the stopping step portions 32*a* and 32*b* of the rotary operation shaft 28. The end faces 37*a*, 37*b* of the step portion 37 of the rotary operation shaft 28 are so set that the center position of the step portion 37 corresponds to a center position between the stopping steps portions 32*a* and 32*b***.

Next, operation of the knob manipulation-type variable resistor of the above-mentioned embodiment will be explained with reference to FIG. 5. FIG. 5 is a sectional view similar to FIG. 3, showing a state of the operation of the knob-manipulation-type variable resistor.

First, as shown by arrow A in FIG. 5, when pushing one side of the end portion of the manipulation knob 30, the rotary operation shaft 28 turns on the circular shaft 29 within the circular through-hole 22 of the tubular holder 21. As a result, the step portion 37 of the manipulation knob 30 pushes the hook portion 36*a* of the torsion coil spring 36 in the direction of the arrow A. Thus, the hook portion 36*a* is released from the end face 38*a* of the protruding portion 38 of the tubular holder 21, and simultaneously the other end face 37*b* of the step portion 37 of the manipulation knob 30 is released from the other hook portion 36*b* of the torsion coil spring 36. At this time, the other end face 38*b* of the protruding portion 38 of the tubular holder 21 is left in contact with the hook portion 36*b*, therefore the torsion coil spring 36 is compressed against the spring force by the hook portions 36*a* and 36*b* of the torsion coil spring 36.

The rotary shaft 25 coupled to the circular shaft 29 of the rotary variable resistor 24 is turned by the rotation of the rotary operation shaft 28, and thereby a resistance value derived from the connection terminals 26 is varied.

Therefore, the resistance value derived from the connection terminals 26 of the rotary variable resistor 24 is varied in a forward direction in a stepless mode in response to a turning angle of the rotary operation shaft 28, that is, an amount of pushing force applied to the manipulation knob 30.

Thereafter, when removing the pushing force applied to the top end of the manipulation knob 30, the rotary operation shaft 28 is returned to the initial position (shown in FIG. 2), because the elasticity of the torsion coil spring 36 is applied to the rotary operation shaft 28 via the step portion 37 of the manipulation knob 30.

In the same manner, when pulling the top end of the manipulation knob 30 to rotate the rotary operation shaft 28, the resistance value derived from the connection terminals 26 of the rotary variable resistor 24 can be varied in the reverse direction to the above-mentioned case of the pushing operation of the manipulation knob 30.

The knob manipulation-type variable resistor of the first embodiment has the following effects:

(1) In the first embodiment, the knob manipulation-type variable resistor is used as an output device for the stepless control, and further the manipulation knob is used instead of a seesaw manipulation key, and further the torsion coil spring is used for the neutral position returning mechanism of the manipulation knob, and thereby the overall size of the electronic device, and especially, the height and width can be reduced.

(2) The knob manipulation-type variable resistor is configured by holding the rotary variable resistor in the holder and installing the rotary operation shaft and the torsion coil spring. In addition, the rotary variable resistor can be manufactured in advance. Therefore, demand for knob manipulation-type electronic devices which use variable resistors having different resistance values can be met by keeping various kinds of rotary variable resistors in stock and assembling them with the rotary operation shaft and torsion coil spring.

(3) The knob manipulation-type electronic device of the neutral position returning mechanism can be configured with simple mechanism having only 3 members, that is, the holder unit, rotary operation shaft unit and the torsion coil spring unit, and thereby can be manufactured with low cost.

(4) If necessary, this knob manipulation-type electronic device can be modified into a seesaw manipulation-type electronic device similar to the conventional seesaw manipulation key by extending the manipulation knob into a bar-shaped level.

Second Embodiment

Hereafter, a knob-manipulation-type variable resistor of a second embodiment of a rotary electronic device in accordance with the present invention will be explained with reference to FIG. 6 to FIG. 9.

Figure 6:
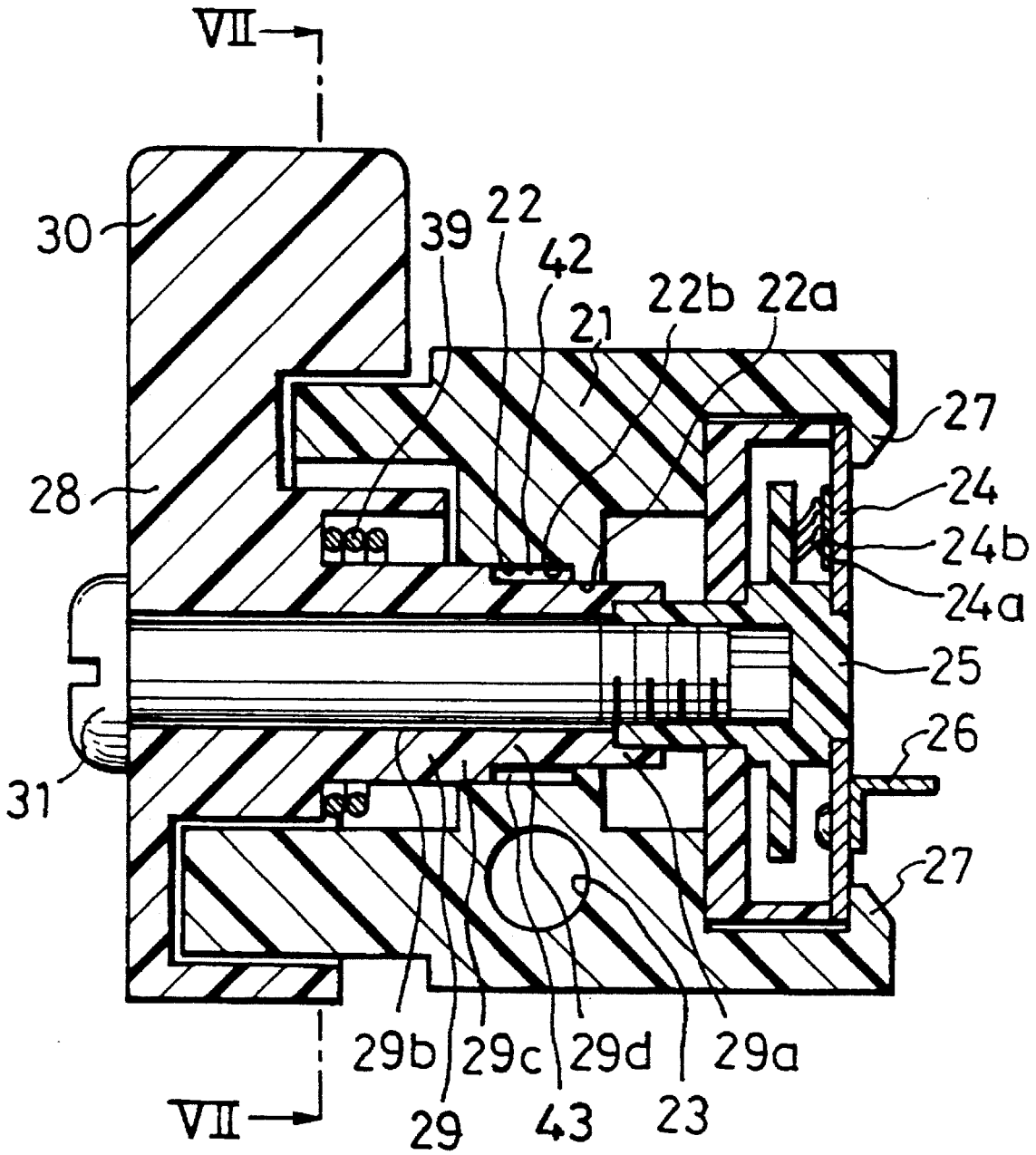
FIG. 6 is a sectional view showing a knob manipulation-type variable resistor of a second embodiment.
Figure 7:
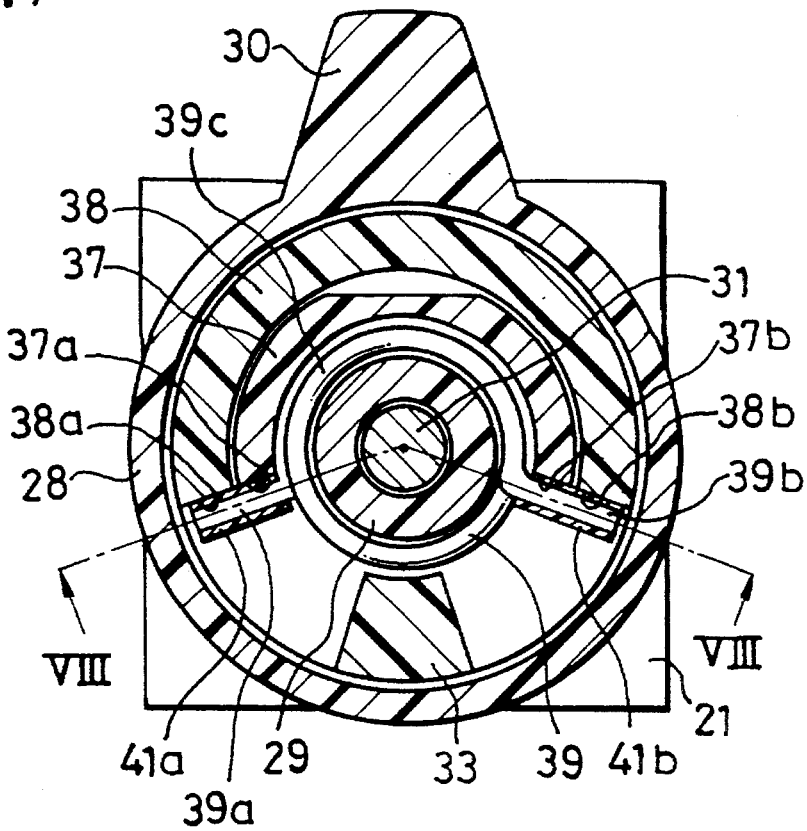
FIG. 7 is a sectional view taken along line VII— VII of FIG. 6.
Figure 8:
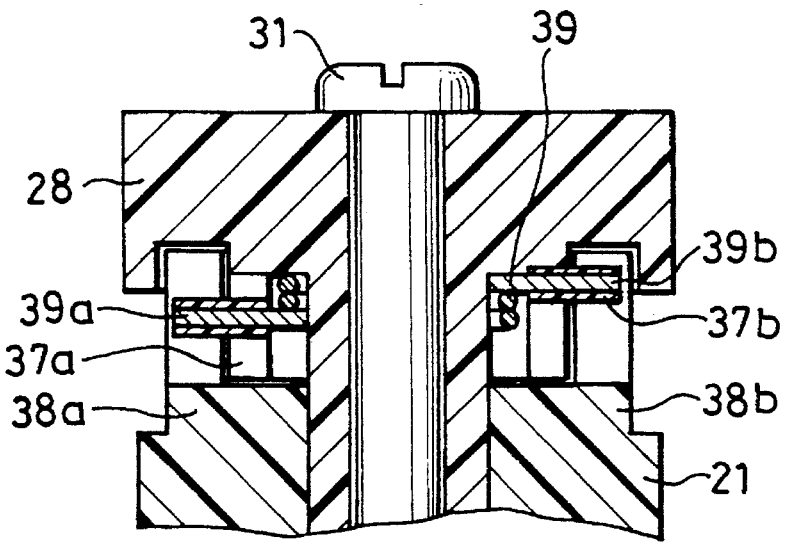
FIG. 8 is a partial sectional view of a rotary operation shaft portion of an essential part taken along line VIII—VIII of FIG. 7.
Figure 9:
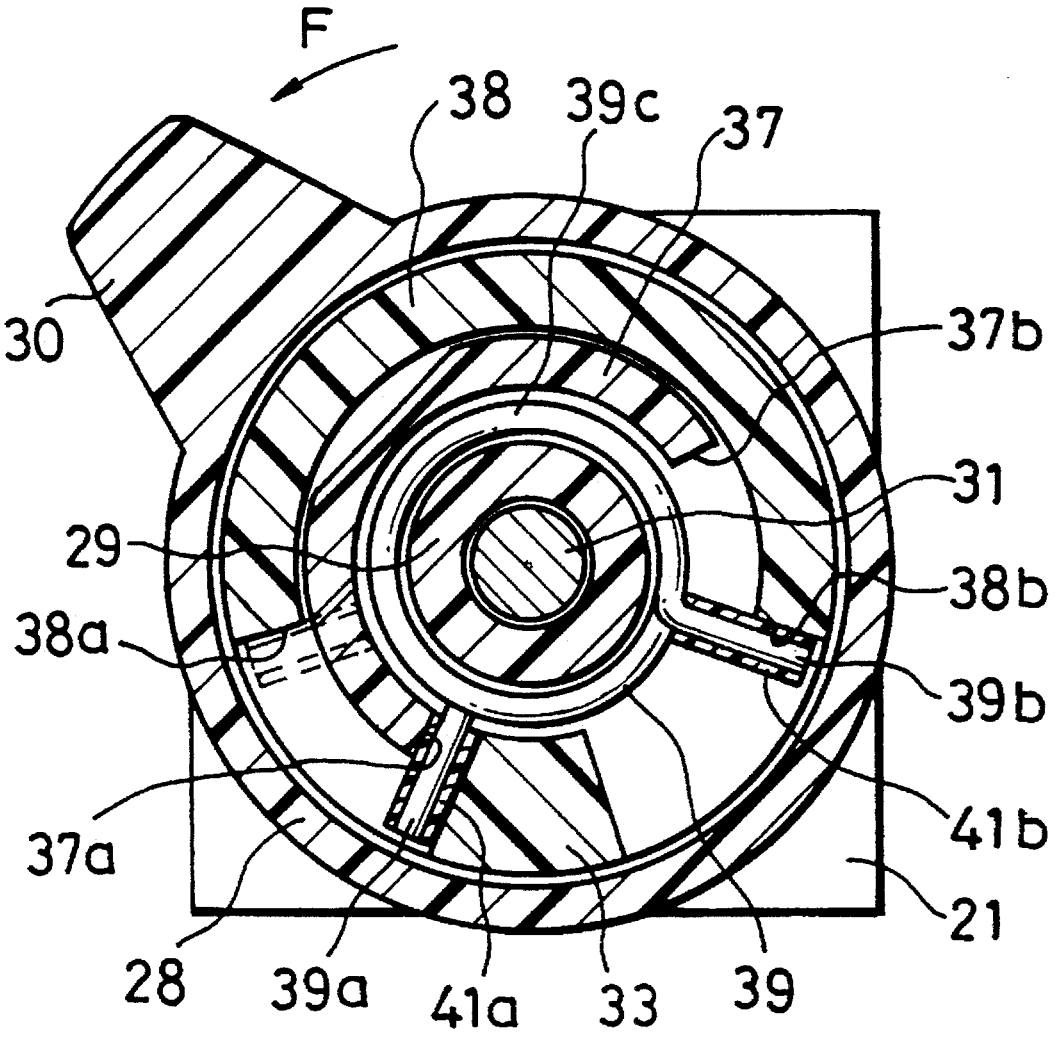
FIG. 9 is a side sectional view showing a state that the knob manipulation-type variable resistor is operated by pushing a manipulation knob, starting from the state of FIG. 7.

FIG. 6 is a sectional view showing the knob manipulation-type variable resistor of the second embodiment. FIG. 7 is a sectional view taken along line VII— VII of FIG. 6. FIG. 8 is a partial sectional view of the rotary operation shaft portion of an essential part taken along line VIII—VIII of FIG. 7. FIG. 9 is a side sectional view showing a state that the knob manipulation-type variable resistor is operated by pushing a manipulation knob, starting from the state of FIG. 7. Corresponding parts and components to the first embodiment are shown by the same numerals and marks, and the description thereon made in the first embodiment similarly apply. Differences and features of this second embodiment from the first embodiment are as follows.

In FIGS. 6–9, a tubular holder 21 made by resin molding or metal die casting has a circular through-hole 22 in its center portion and a fixing-use small hole 23 in its side portion. As shown in FIG. 6, this circular through-hole 22 has a step, and a diameter of a right end portion 22*a* of the circular through-hole 22 is slightly smaller than a diameter of a left portion 22*b*.

A rotary variable resistor 24 has a rotary shaft 25 in the center portion of the tubular holder 21, and connection terminals 26 on the rear face. The rotary shaft 25 is so held by leg portions 27 at an end of the tubular holder 21 that it is concentric with the circular through-hole 22 of the tubular holder 21. A plurality of connection terminals 26 protrude from the rear face of the knob manipulation-type variable resistor. A brush 24*a* contacts and slides on resistor 24*b* by turning said rotary shaft 25, and thereby an output (resistance value) derived from the connection terminal 26 is varied.

A rotary operation shaft 28 comprises a circular shaft 29 rotatably held by the circular through-hole 22 of the tubular holder 21 and a manipulation knob 30, which radially extends from an end portion of the circular shaft 29. The other end 29*a* of the circular shaft 29 is coupled to the rotary shaft 25 of the rotary variable resistor 24, and a screw 31 inserted into a center hole 29*b* of the circular shaft 29 fixes both of the rotary shaft 25 and the circular shaft 29.

As shown in FIG. 6, the cylindrical outer face of this circular shaft 29 has a step. At contact portion of the circular shaft 29 which is in contact with the circular through-hole 22 of the tubular holder 21, a left end portion 29*c* of the circular shaft 29 has a larger diameter than a right portion 29*d*. The left end portion 29*c* of the circular shaft 29 is in contact with a large diameter portion, that is, left portion 22*b* of the circular through-hole 22. A right end portion 29*a* of circular shaft 29 is connected with a small diameter portion, that is, the right end portion 22*a* having a smaller inner diameter than that of the left portion 22*b* of the circular through-hole 22.

Thus, in the contact portion between the circular through-hole 22 of the tubular holder 21 and the circular shaft 29 of the rotary operation shaft 28, a gap 42 is formed at an intermediate portion of the contacted portion, but both the right and left ends of the contact portion have almost no clearance and the circular shaft 29 are rotatably held by the circular through-hole 22. This gap 42 is filled with viscous grease 43 and serves as a grease reservoir, and thereby a damping function is provided to provide some resistance against rotation of the rotary operation shaft 28.

As shown in FIG. 7, the end faces 37*a*, 37*b* of the step portion 37 of the manipulation knob 30 of the rotary operation shaft 28 are in contact with a protrusion 33 of the tubular holder 21 via hook portions 39*a*, 39*b*, so as to regulate a range of turning angles of the rotary operation shaft 28. These end faces 37*a*, 37*b* of the step portion 37 also serve as contact-use step portions of the hook portions 39*a*, 39*b* which is both ends of a torsion coil spring 39 for maintaining the rotary operation shaft 28, namely the manipulation knob 30 at a neutral position. That is, a coil portion 39*c* of the torsion coil spring 39 is disposed on a periphery of the circular shaft 29 of said rotary operation shaft 28. Furthermore, the hook portions 39*a*, 39*b* sheathed with soft elastic tubes 41*a*, 41*b*, such as neoplene tubes or rubber tubes etc. are in contact with the end faces 37*a*, 37*b* of the step portion 37 as stopper of the rotary operation shaft 28, and further hook portions 39*a*, 39*b* are in contact with the end faces 38*a*, 38*b* of the protruding portion 38 arranged on the outside of the step portion 37. The end faces 38*a*, 38*b* are arranged to have the same facing angle as the end faces 37*a*, 37*b* of the step portion 37. The hook portions 39*a*, 39*b* of the torsion coil spring 39 shown in FIG. 7 are in contact with these end faces 37*a*, 37*b*, 38*a* and 38*b* of the step portion 37 and the protruding portion 38 to apply a constant elasticity of the torsion coil spring 39 through the hook portions 39*a*, 39*b*.

Next, operation of the knob manipulation-type variable resistor of the above-mentioned embodiment will be explained with reference to FIG. 9. FIG. 9 is a sectional view showing the operation of the knob manipulation-type variable resistor.

First, as shown by arrow F in FIG. 9, when pushing one side of the end portion of the manipulation knob 30, the rotary operation shaft 28 turns on the circular shaft 29 contacted with the circular through-hole 22 of the tubular holder 21. Thus, the step portion 37 of the manipulation knob 80 pushes the hook portion 39*a*, which is sheathed with the elastic tube 41*a*, of the torsion coil spring 39 in the direction shown with the arrow F in FIG. 9. The end face 38*a* of the protruding portion 38 of the holder 21 is released from the hook portion 39*a*, and simultaneously the other end face 37*b* of the step portion 37*b* of the manipulation knob 30 is released from the other hook portion 39*b* sheathed with the elastic tube 41*b* of the torsion coil spring 39. At this time, the other end face 38*b* of the protruding portion 38 of the tubular holder 21 is in contact with the elastic tube 41*b* of the hook portion 39*b*, and therefore the torsion coil spring 39 is compressed against the spring force by both the hook portions 39*a* and 39*b* of the torsion coil spring 39.

At this time, rotation of the rotary operation shaft 28 does not become too rapid because of the damping effect due to the resistance force of the viscous grease 43 filled in the gap 42 between the circular shaft 29 and the circular through-hole 22 of the tubular holder 21.

As the rotary operation shaft 28 of the rotary variable resistor 24 rotates, the rotary shaft 25 coupled to the circular shaft portion 29 of the rotary operation shaft 28 is rotated, and thereby a resistance value derived from the connection terminals 26 is varied.

Therefore, the resistance value derived from the connection terminal 26 of the rotary variable resistor 24 varies in the predetermined direction in response to a turning angle of the rotary operation shaft 28, namely, an amount of pushing force applied to the manipulation knob 30.

At the end of a turning angle range of the rotary operation shaft 28, the end face 37*a* of the step portion 37 of the manipulation knob 30 presses the hook portion 39*a* of the torsion coil spring 39 to the protrusion 33 of the tubular holder 21. Because the hook portion 39*a* is sheathed with the elastic tube 41*a*, noise at the time of contact between the hook portion 39*a* and the step portion 37 is reduced.

Therefore, when removing the pushing force applied to the manipulation knob 30, the rotary operation shaft 28 is returned to the initial neutral position (shown in FIG. 7) and restored because the elasticity of the torsion coil spring 39 is applied to the rotary operation shaft 28 via the step portion 37 of the manipulation knob 30.

As the rotary operation shaft returns to the initial neutral position rotation of the rotary operation shaft 28 does not become rapid because of the buffer effect due to the viscous grease 43 filled in the gap 42 between the circular shaft 29 and the circular through-hole 22. When the rotary operation shaft 28 returns to the neutral position (state shown in FIG. 7), the hook portion 39*a* of the torsion coil spring 39 is in contact with the end face 38*a* of the protruding portion 38 of the tubular holder 21, and the other hook portion 39*b* is in contact with the end face 37*b* of the step portion 37 of the manipulation knob 30. Because these hook portions 39*a*, 39*b* are respectively sheathed with the elastic tubes 41*a*, 41*b* to absorb the noise at the contact, the noise at the contact between the hook portion 39*a* or 39*b* and the step portion 37 is reduced by the elastic tubes 41*a*, 41*b*.

Similarly, when pushing one side of the top end portion of the manipulation knob 30 in the reverse direction to the above-mentioned case, and turning the rotary operation shaft 28, the resistance value produced at the connection terminals 26 of the rotary variable resistor 24 can be varied in the reverse direction to the above-mentioned case.

Apart from the above-mentioned second embodiment wherein the knob manipulation-type variable resistor is used as a rotary electronic device, a modified embodiment may be such that a knob manipulation-type switch is constructed by changing the rotary variable resistor to a rotary change-over switch.

The above-mentioned second embodiment has the following effects in addition to the aforementioned effects of the first embodiment shown in FIG. 1 to FIG. 5:

(1) In the knob manipulation-type rotary electronic device which has the buffer function using the viscous grease between the rotary operation shaft and the circular through-hole of the tubular holder which holds the rotary operation shaft, the rotary operation shaft does not rotate rapidly, and thereby the contact portions are not violently struck by the end of the turning angle range.

Furthermore, resistance force against rotation of the rotary operation shaft in the buffer function produced by the viscous grease can be controlled by selecting the kinds of viscous grease and capacity of the grease reservoir, and (2) In the knob manipulation-type electronic device which has the torsion coil spring, noise resulting upon contact at the end of a turning angle range of the rotary operation shaft can be reduced by the hook portions which is sheathed with the elastic tubes.

By using both of these two noise-reduction means, noise due to zooming operation at recording is reduced, and thereby the noise in the recorded sound can be perfectly eliminated even when using a video camera microphone having high sensitivity.

Third Embodiment

Figure 10:
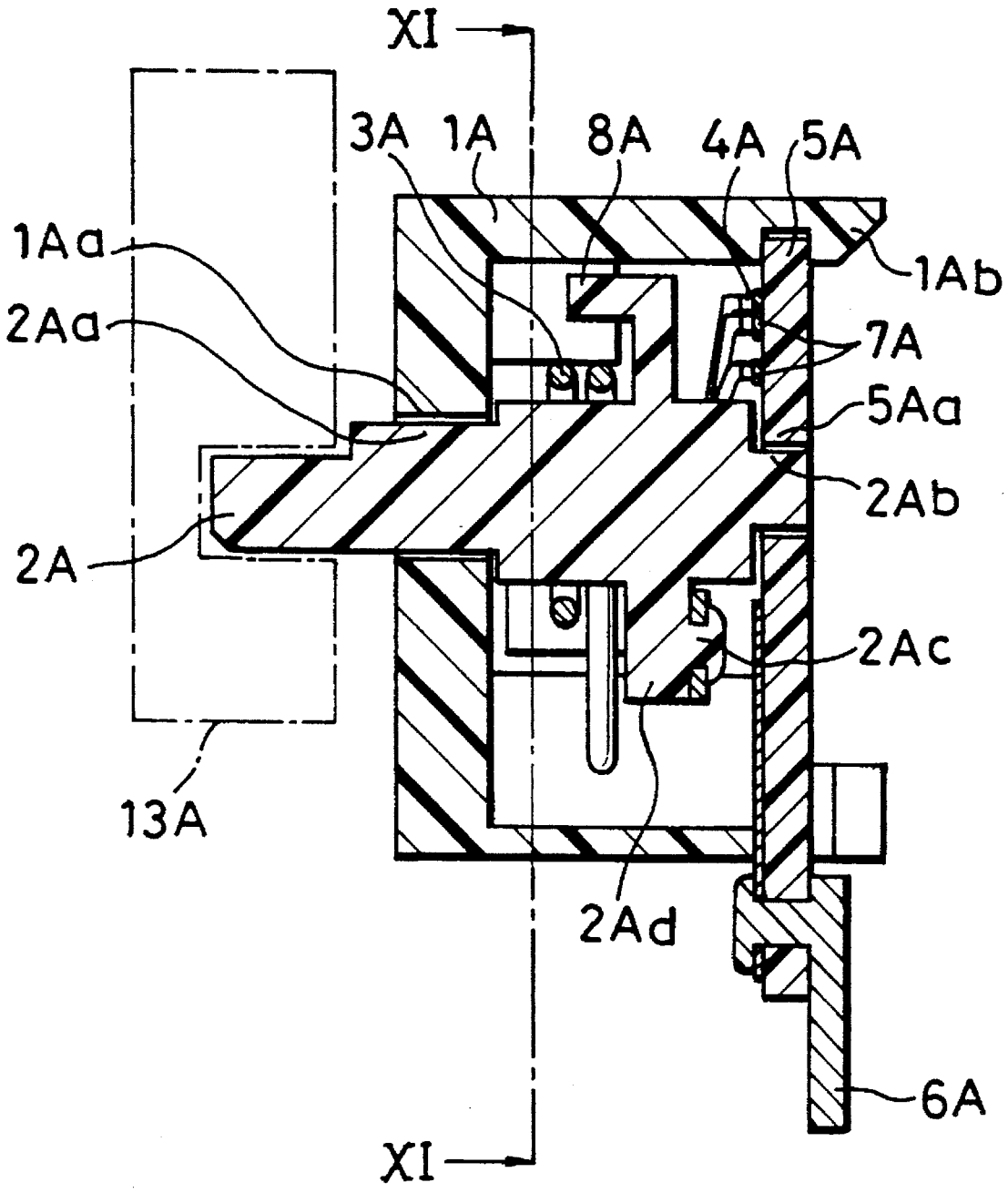
FIG. 10 is a sectional view showing a rotary variable resistor of a third embodiment.

Hereafter, a third embodiment of a rotary electronic device in accordance with the present invention is elucidated with reference to the accompanying drawings of FIG. 10 to

FIG. 12.

Figure 11:
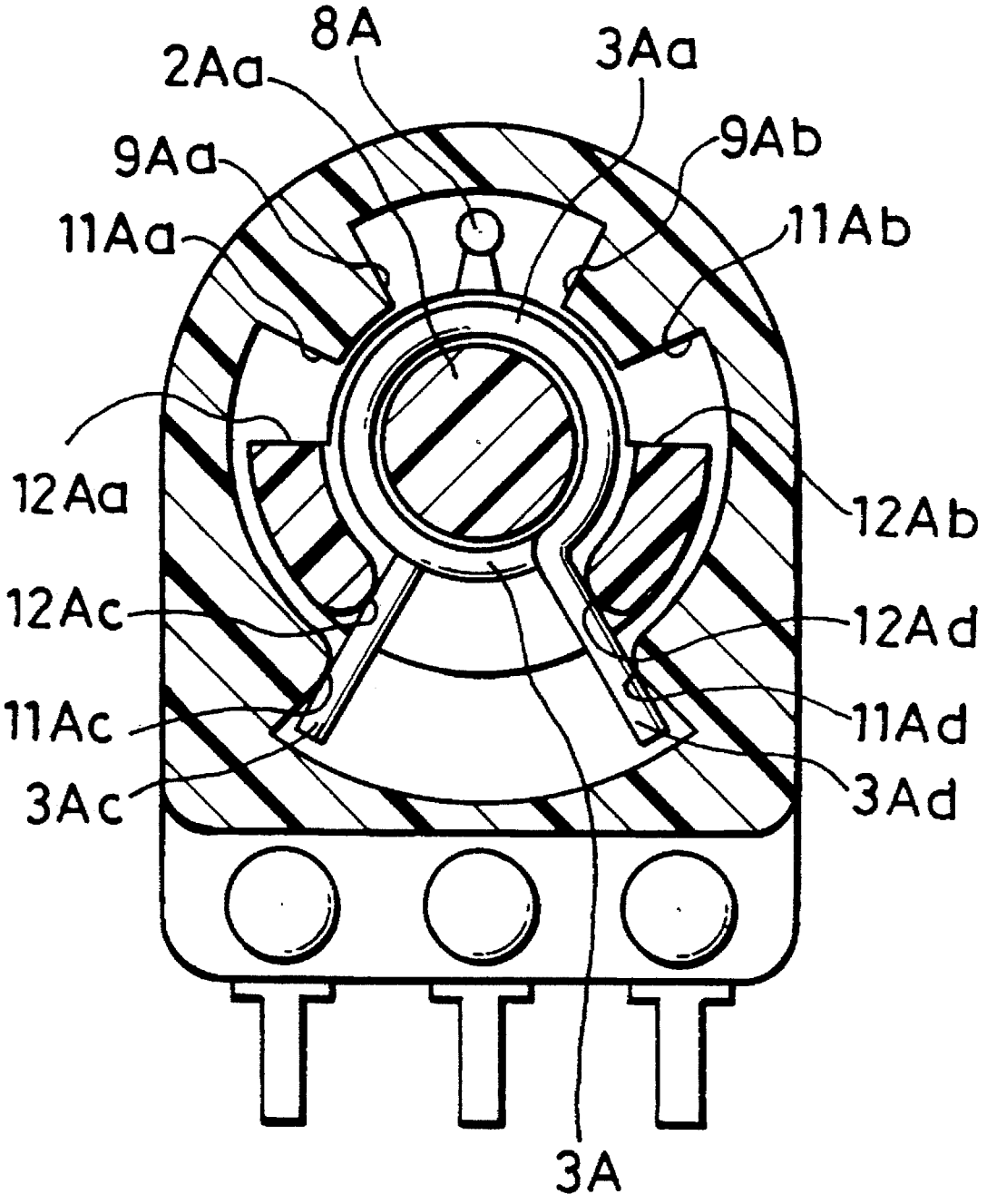
FIG. 11 is a sectional view taken along line XI— XI of FIG. 10.
Figure 12:
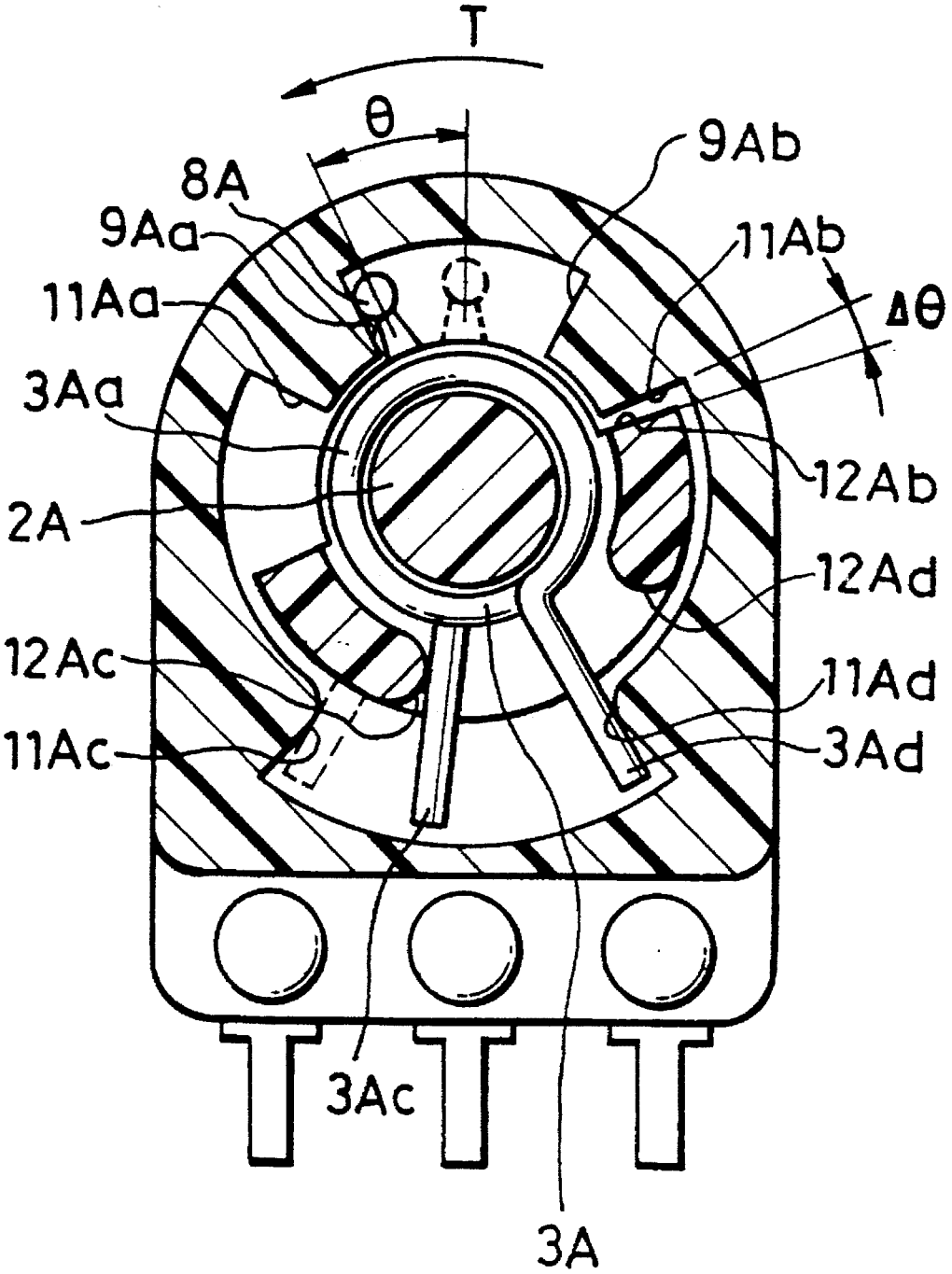
FIG. 12 is a sectional view showing a state that the rotary variable resistor is operated by turning a rotary manipulation shaft, starting from the state of FIG. 11.

FIG. 10 to FIG. 12 show a rotary variable resistor of the third embodiment of a rotary electronic device in accordance with the present invention. FIG. 10 is a sectional view showing the rotary variable resistor of the third embodiment. FIG. 11 is a sectional view taken along line XI—XI of FIG. 10. FIG. 12 is a sectional view showing a state that the rotary variable resistor is operated by turning a rotary manipulation shaft, starting from the state of FIG. 11. Corresponding parts and components to the first embodiment are shown by the same numerals and marks, and the description thereon made in the first embodiment similarly apply. Differences and features of this third embodiment from the first embodiment are as follows.

In FIG. 10, the rotary variable resistor can be converted into a knob manipulation-type variable resistor like the aforementioned first and second embodiments shown in FIG. 1 to FIG. 9, by attaching a knob 13A (shown with clain-line) to a rotary operation shaft 2A.

Explaining a detailed structure with reference to FIGS. 10–12, a box-shape casing 1A made by resin molding or die casting has a circular through-hole 1A*a* in its center portion. A rotary operation shaft 2A is rotatably held by the circular through-hole 1A*a* of the box-shape casing 1A at a circular shaft portion 2A*a*.

In FIG. 11, two stopping protruding portions 12A*a*, 12A*b* of the rotary operation shaft 2A are provided to be respectively in contact with two stopping step portions 11A*a*, 11A*b* of the box-shape casing 1A so as to restrain a turning angle range of the rotary operation shaft 2A. A flexible protrusion 8A is provided so as to contact with stopping step portion 9A*a* or 9A*b* of the box-shape casing 1A immediately before contacting of the stopping protruding portion 12A*a* or 12A*b* with the stopping step portion 11A*a* or 11A*b*, when the rotary operation shaft 2A is turned as described later.

A torsion coil spring 3A for holding the rotary operation shaft 2A at the neutral position, and a coil portion 3A*a* of the torsion coil spring 3A is disposed on an outer periphery of the circular shaft portion 2A*a* of the rotary operation shaft 2A. Hook portions 3A*c*, 3A*d* at both ends of the coil portion 3A*a* are in contact with protruding portions 12A*c*, 12A*d* of the rotary operation shaft 2A, respectively. The hook portions 3A*c*, 3A*d* are in contact with stopping step portions 11A*c*, 11A*d* of the box-shape casing 1A. As shown in FIG. 11, the stopping step portions 11A*c*, 11A*d* are arranged at an outer position of the protruding portions 12A*c*, 12A*d*. The hook portions 3A*c*, 3A*d* are in contact with the stopping step portions 11A*c*, 11A*d* and the stopping protruding portions 12A*c*, 12A*d* to apply a constant elasticity of the torsion coil spring 3A.

In FIG. 10, a base plate 5A is supported by a leg portion 1A*b* of the box-shape casing 1A so that a circular through-hole 5A*a* of the base plate 5A and the circular through-hole 1A*a* of the box-shape casing 1A are concentric. The circular shaft portion 2A*b* of the rotary operation shaft 2A is rotatably held by the circular through-hole 5A*a* and the circular through-hole 1A*a*.

A plurality of terminals 6A, which protrude from one side of the base plate 5A, are electrically connected to a circular resistance layer 7A on the base plate 5A. An output (resistance value) derived from the terminals 6A is varied by sliding a brush 4A on said circular resistance layer 7A. The brush 4A is fixed by a holding portion 2A*c* on one face of an intermediate disk portion 2A*d* of the rotary operation shaft 2A so as to rotate together with the holding portion 2A*c*.

Next, operation of the above-mentioned rotary variable resistor of the third embodiment will be explained with reference to FIG. 12, which is a sectional view showing an operation state thereof.

When the rotary operation shaft 2A is turned by turning the angle of θ in the direction of an arrow T in FIG. 12, the flexible protrusion 8A of the rotary operation shaft 2A touches with the stopping step portion 9A*a* of the box-shape casing 1A. At the same time, the stopping protruding portion 12A*b* of the rotary operation shaft 2A and the stopping step portion 11A*b* of the box-shape casing 1A do not contact with each other, and disposed to have a gap Δθ as shown in FIG. 12.

When the rotary operation shaft 2A is rotated further by the turning angle of Δθ, the flexible protrusion 8A of the rotary operation shaft 2A and the stopping step portion 9A*a* are contacting in a state that the flexible protrusion 8A of the rotary operation shaft 2A is bent by the turning angle of Δθ. As a result, the stopping protruding portion 12A*b* of the rotary operation shaft 2A and the stopping step portion 11A*b* of the box-shape casing 1A touch each other. By these contactings, the turning angle range of the rotary operation shaft 2A are restrained.

Noise at the contact is reduced as a result of cushion effect of the contact between the flexible protrusion 8A of the rotary operation shaft 2A and the stopping step portion 9A*a* of the box-shape casing 1A immediately before contacting of the stopping protruding portion 12A*b* of the rotary operation shaft 2A with the stopping step portion 11A*b* of the box-shape casing 1A.

Apart from the above-mentioned third embodiment wherein the rotary electronic device is the rotary-type automatic return variable resistor, a modified embodiment may be configured such that the rotary electronic device is a rotary-type automatic return switch which is constructed by changing the variable resistor to a rotary change-over switch.

Figure 13:
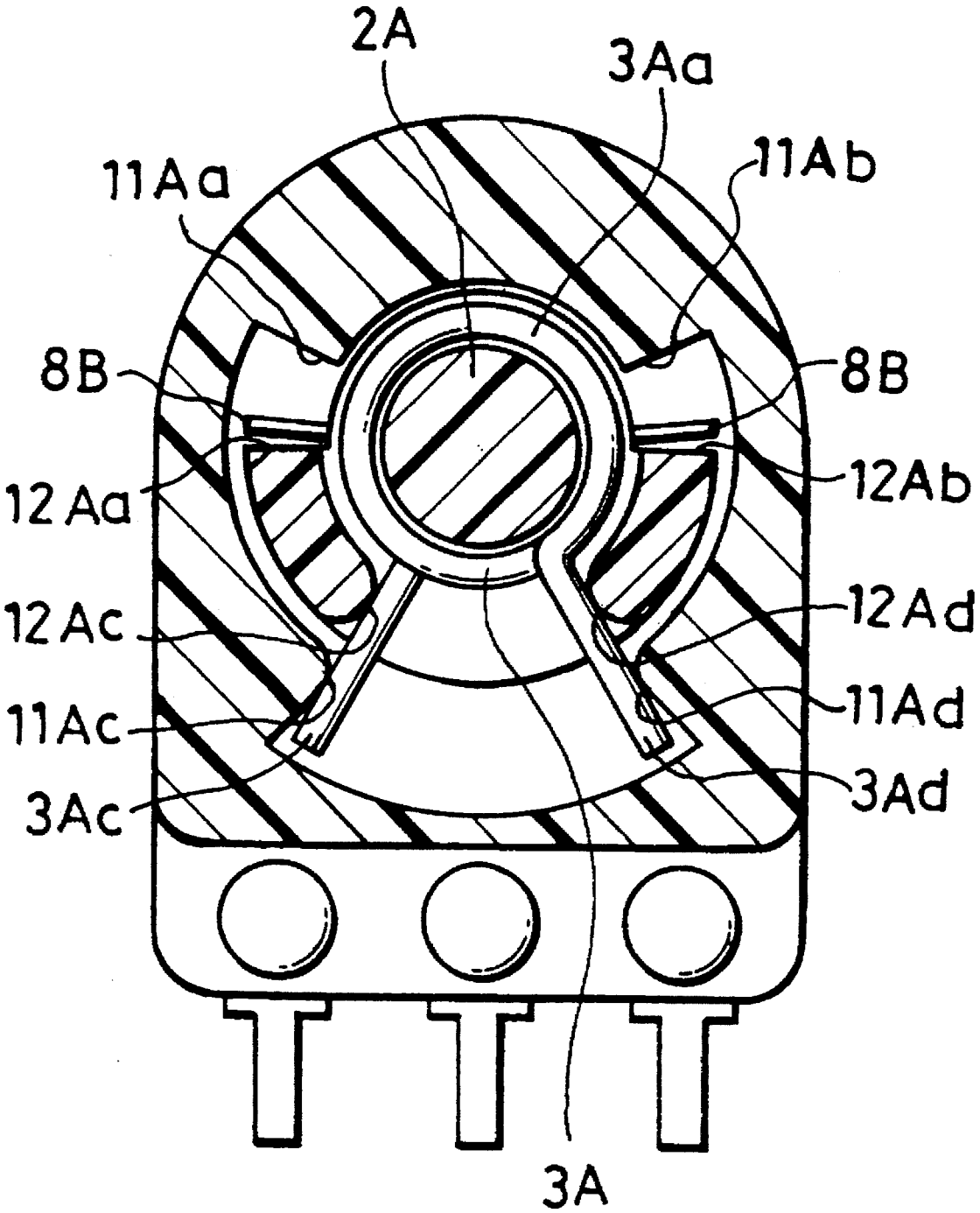
FIG. 13 is a sectional view showing a rotary variable resistor of another embodiment.

FIG. 13 is a sectional view showing a rotary variable resistor of another embodiment. In FIG. 13, two flexible protrusion 8B are provided on the rotary operation shaft 2A and arranged to be in contact with the stopping step portions 11A*a*, 11A*b* of the box-shape casing 1A, respectively. Therefore, the flexible protrusion 8B is in contact with the stopping step portion 11A*a* or 11A*b* immediately before contacting of the stopping protruding portion 12A*a* or 12A*b* with the stopping step portion 11A*a* or 11A*b*. Therefore, the rotary variable resistor shown in FIG. 13 has the same effect as the third embodiment of FIG. 12. In this embodiment shown in FIG. 13, noise at the contact in the operation is reduced by the cushion effect of the flexible protrusion 8B.

Figure 14:
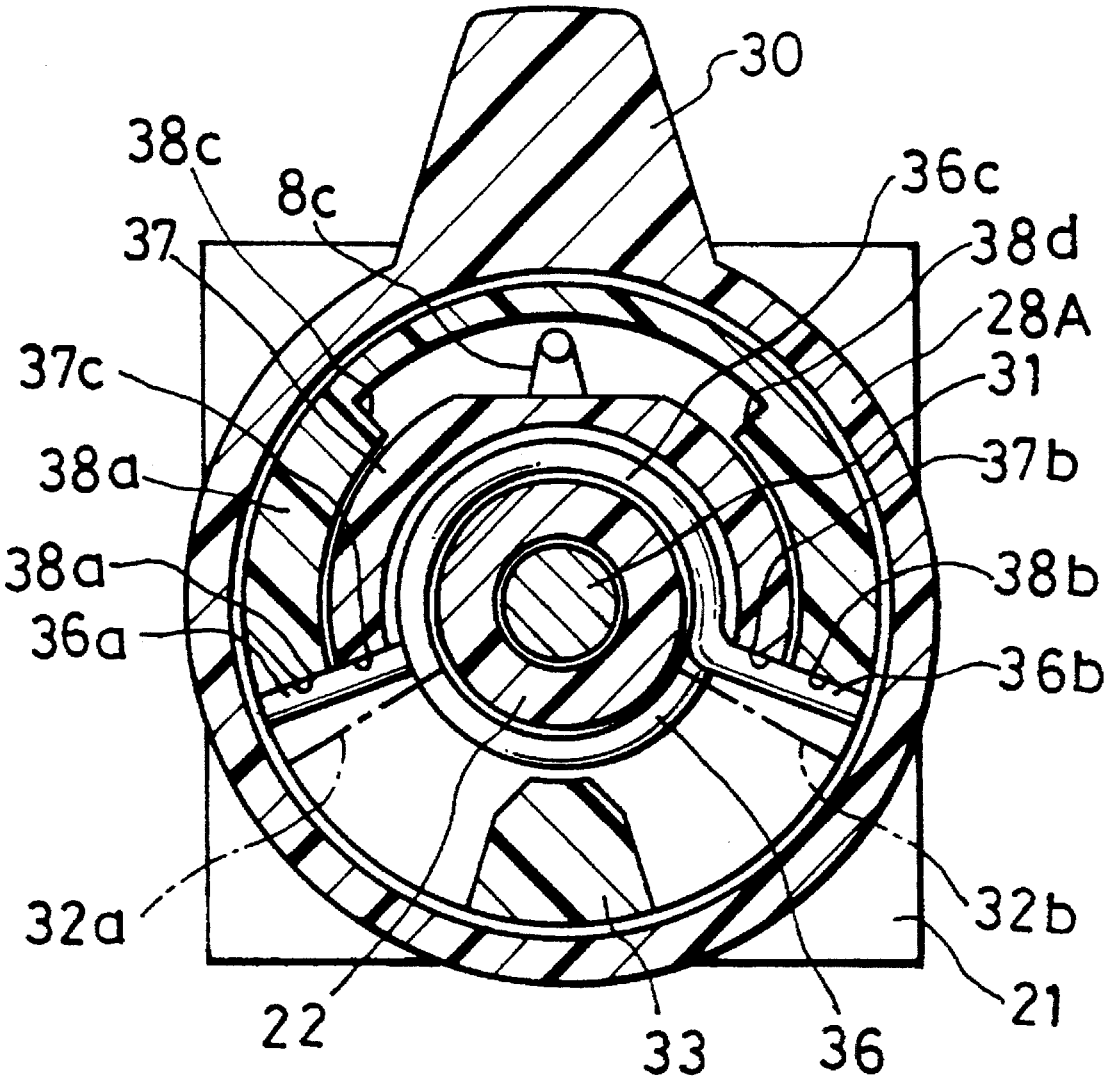
FIG. 14 is a sectional view showing a knob manipulation-type variable resistor of another embodiment.
Figure 15:
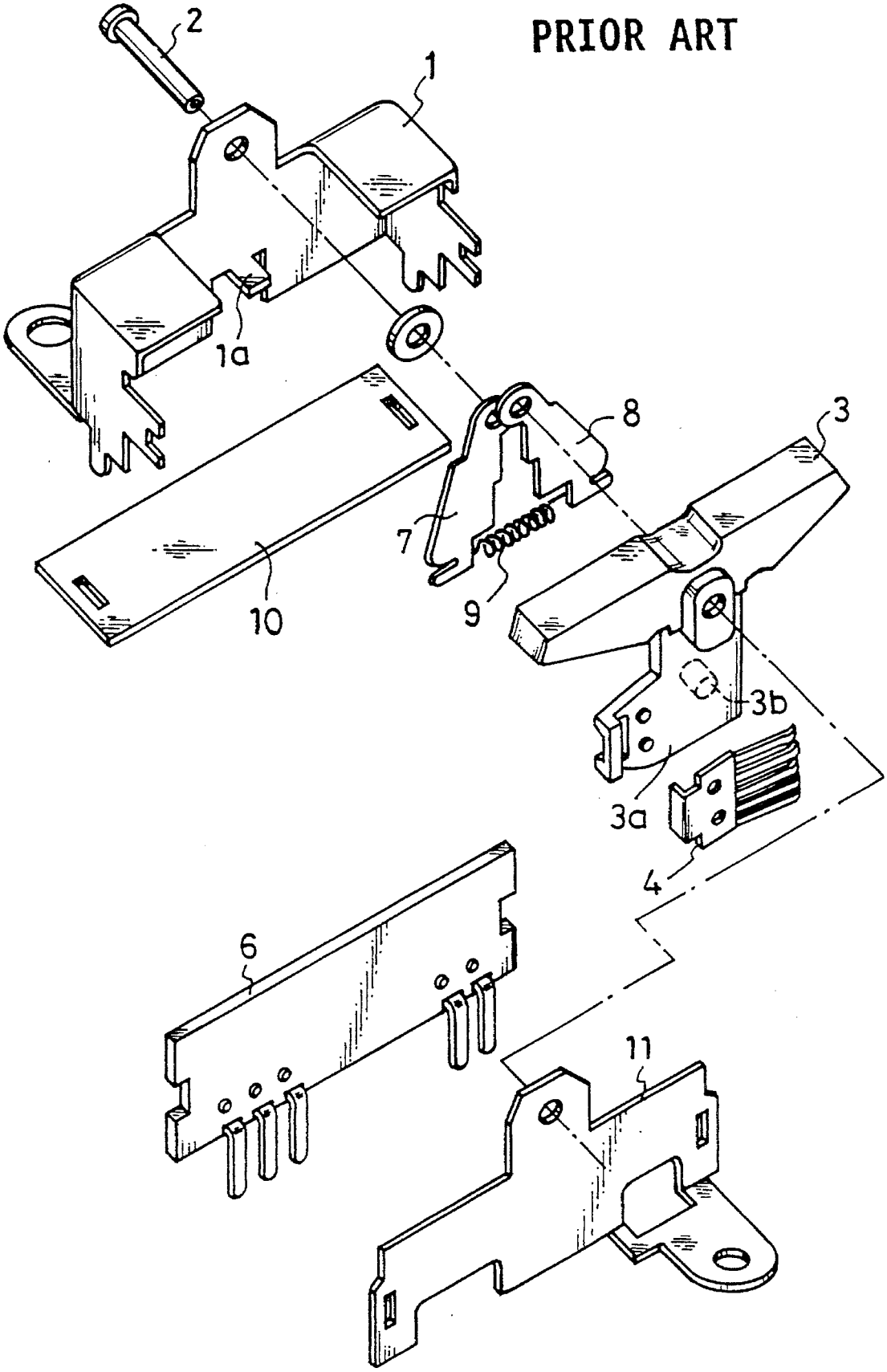
FIG. 15 PRIOR ART
FIG. 15 is an exploded perspective view showing the seesaw manipulation-type switch of a conventional seesaw manipulation-type electronic device of FIG. 15.
Figure 16:
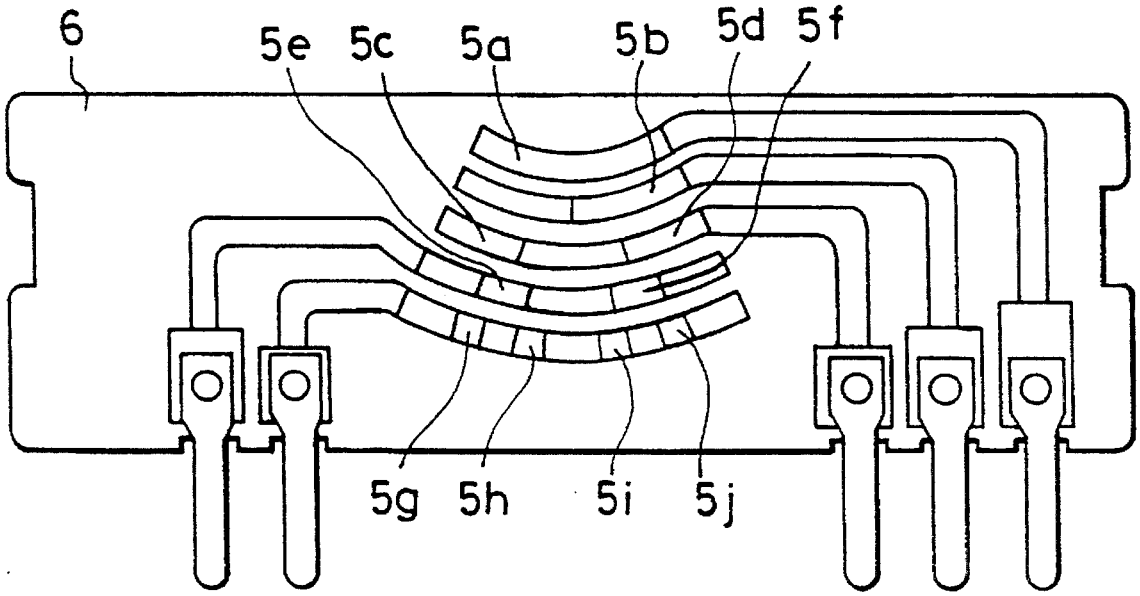
FIG. 16 PRIOR ART
FIG. 16 is the front view showing a base plate of the conventional seesaw manipulation-type electronic device of FIG. 15.
Figure 17:
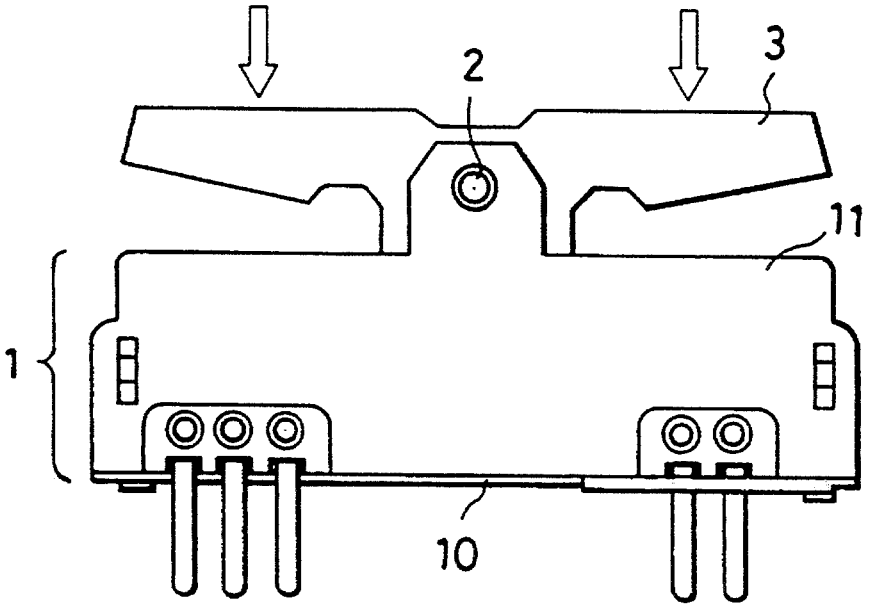
FIG. 17 PRIOR ART
FIG. 17 is the front view of a base plate of FIG. 16.
Figure 18:
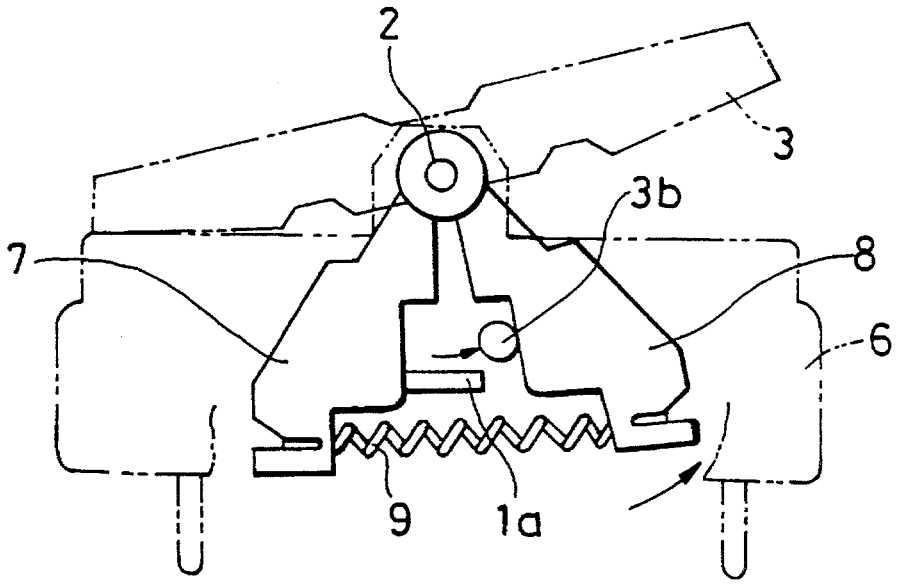
FIG. 18 PRIOR ART
FIG. 18 is a front view explaining the operation of the return mechanism of the conventional seesaw manipulation-type electronic device.

FIG. 14 shows a rotary manipulation-type variable resistor of still another embodiment in accordance with the present invention. The rotary manipulation-type variable resistor has the rotary operation shaft 28A integrally provided with a flexible protrusion 8*c*, which is provided to position in a recess equipped in the tubular holder 21. Thereby, this flexible protrusion 8*c* is in contact with a step portion 38*c* or 38*d* of the tubular holder 21 immediately before contacting of the stopping step portion 32*a* or 32*b* of the rotary operation shaft 28A with the protrusion 33 of the tubular holder 21. As a result, the noise at the contact is reduced in the operation of the rotary operation shaft 28A.

According to the above-mentioned embodiments shown in FIG. 10 to FIG. 14, the flexible protrusion of the rotary operation shaft is in contact with the stopping step portion of the casing portion at the end of the turning angle range of the rotary operation shaft immediately before contacting of the stopping protruding portion of the rotary operation shaft and the stopping step portion of the casing with each other. Thereby, these embodiments have particular effects that the contact noise can be reduced by the cushion effect, and noise in recording owing to operation for zooming can be reduced. Accordingly, noise reproduced in a play back can be eliminated even when using a video camera microphone of high sensitivity.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. A rotary electronic device comprising:

a holder having a circular through-hole defined therein, a protrusion and a protruding portion extending therefrom;

a rotary variable resistor having connection terminals and a rotary shaft, said rotary shaft being concentrically arranged with respect to said circular through-hole, said rotary variable resistor being disposed at an end portion of said holder;

a rotary operation shaft rotatably provided within said circular through-hole, one end of said rotary operation shaft being coupled to said rotary shaft of said rotary variable resistor, and another end of said rotary operation shaft including a stopping step portion for engaging said protrusion of said holder so as to restrain a turning angle of said rotary operation shaft and a step portion; and a rotation return mechanism including a torsion coil spring disposed on a circumference of said rotary operation shaft, wherein said torsion coil spring has hook portions at both ends thereof, said hook portions of torsion coil spring engaging two portions of said step portion of said rotary operation shaft near said stopping step portions and two portions of said protruding portion of said holder, said two portions of said protruding portion having a same facing angle as said two portions of said step portion.

2. A rotary electronic device comprising:

a holder having a circular through-hole defined therein and a protrusion extending therefrom;

a rotary variable resistor having connection terminals and a rotary shaft, said rotary shaft being concentrically arranged concentrically with respect to said circular through-hole, said rotary variable resistor being disposed at an end portion of said holder;

a rotary operation shaft rotatably provided within said circular through-hole, wherein a gap between said holder and said rotary operation shaft is defined at an intermediate area of a contacting portion between said holder and said rotary operation shaft, one end of said rotary operation shaft being coupled to said rotary shaft of said rotary variable resistor, and another end thereof including a stopping step portion for engaging said protrusion of said holder so as to restrain a turning angle of said rotary operation shaft, and a manipulation knob; and viscous grease provided in said gap between said holder and said rotary operation shaft.

3. A rotary electronic device in accordance with claim 2, wherein said holder includes a protruding portion, said rotary operation shaft includes a step portion, and said rotary electronic device further comprises:

a rotation return mechanism including a torsion coil spring disposed on a circumference of said rotary operation shaft, wherein said torsion coil spring includes hook portions at both ends thereof, said hook portions being sheathed with elastic tubes and engaging two portions of said step portion of said rotary operation shaft and two portions of said protruding portion of said holder, said two portions of said protruding portion having a same facing angle as said two portions of said step portion.

4. A rotary electronic device comprising:

a box-shape casing having a circular through-hole and a stopping step portion surrounding a portion of said circular through-hole;

a base plate including a circular resistance layer disposed thereon, said base plate being coupled to said box-shape casing such that a circular through-hole defined in a center portion of said base plate is concentric with said circular through-hole of said box-shape casing; and a rotary operation shaft rotatably provided within said circular through-hole of said box-shape and said circular through-hole of said base plate, said rotary operation shaft including:

a brush sliding on said circular resistance layer, a stopping protruding portion for engaging a first portion of said stopping step portion of said box-shape casing so as to restrain a turning angle of said rotary operation shaft, and a flexible protrusion which contacts a second portion of said stopping step portion of said box-shape casing.

5. A rotary electronic device in accordance with claim 4, wherein said box-shape casing includes two stopping step portions, and said flexible protrusion contacts one of said two stopping step portions of said box-shape casing immediately before the other one of said two stopping step portions of said box-shape casing contacts said stopping protruding portion of said rotary operation shaft.

6. A rotary electronic device in accordance with claim 4 or 5, wherein said box-shape casing includes a step portion, said rotary operation shaft includes a protruding portion, and said rotary electronic device further comprises:

a rotation return mechanism including a torsion coil spring disposed on a circumference of said rotary operation shaft, wherein said torsion coil spring includes hook portions at both ends thereof, said hook portions of said torsion coil spring engaging said protruding portion of said rotary operation shaft and two portions of said step portion of said box-shape casing, said two portions of said step portion of said box-shape casing having a same facing angle as said two portions of said protruding portion of said rotary operation shaft.

7. A rotary electronic device comprising:

a rotation return mechanism having a torsion coil spring disposed on a circumference of a rotary operation shaft, hook portions at both ends of said torsion coil spring being hooked to a protruding portion of said rotary operation shaft at two positions thereof and being hooked to two portions of a step portion of a holder rotatably coupled to said rotary operation shaft, said two positions of said protruding portion and said two portions of said step portion having a same facing angle.

8. A rotary electronic device comprising;

a rotation return mechanism having a torsion coil spring disposed on a circumference of a rotary operation shaft, said torsion coil spring including hook portions at both ends of said torsion coil spring, said hook portions being sheathed with elastic tubes, and said hook portions being hooked to a protruding portion of said rotary operation shaft at two positions thereof and being hooked to two portions of a step portion of a holder rotatable coupled to said rotary operation shaft, said two positions of said protruding portion and said two portions of said step portion having a same facing angle.

* * * * *